US005403157A

United States Patent [19]

Moore

[11] Patent Number: 5,403,157

[45] Date of Patent: Apr. 4, 1995

[54] HEAT EXCHANGE MEANS FOR OBTAINING TEMPERATURE GRADIENT BALANCE

[75] Inventor: Robert P. Moore, Tequesta, Fla.

[73] Assignee: United Technologies Corporation, Hartford, Conn.

[21] Appl. No.: 164,090

[22] Filed: Dec. 8, 1993

[51] Int. Cl.[6] ..... F01D 5/18

[52] U.S. Cl. ..... 416/46 R; 416/97 R; 415/115

[58] Field of Search ..... 415/115, 116; 416/95, 416/96 R, 96 A, 97 R; 165/168, 169, 170

[56] References Cited

U.S. PATENT DOCUMENTS

| | | | |
|---|---|---|---|
| 4,574,876 | 3/1986 | Aid | 165/170 |
| 4,587,700 | 5/1986 | Curbishley et al. | 416/95 |
| 4,775,296 | 10/1988 | Schwarzmann et al. | 415/115 |
| 4,992,026 | 2/1991 | Ohtomo et al. | 415/115 |

FOREIGN PATENT DOCUMENTS

| | | | |
|---|---|---|---|
| 0741680 | 8/1966 | Canada | 165/170 |
| 0001804 | 1/1986 | Japan | 416/97 R |
| 1291093 | 2/1987 | U.S.S.R. | 165/169 |

*Primary Examiner*—Edward K. Look
*Assistant Examiner*—Christopher Verdier
*Attorney, Agent, or Firm*—Norman Friedland

[57] ABSTRACT

The heat exchange rate in a passage in indirect heat exchange with a fluid medium is tailored to match its temperature gradient by "short circuiting" the flow in the passage to minimize heat transfer in regions requiring less heat exchange and maximizing heat transfer in regions requiring more heat exchange. The serpentine passageways of an air cooled turbine blade for a gas turbine engine is short circuited to match the temperature profile of the gas path passing by the blade.

5 Claims, 3 Drawing Sheets

HEAT EXCHANGE MEANS FOR OBTAINING TEMPERATURE GRADIENT BALANCE

TECHNICAL FIELD

This invention relates to means for controlling the heat exchange rate in a serpentine passageway to attain a gradient balance to match the temperature gradient of the medium that is in indirect heat exchange therewith.

BACKGROUND ART

While this invention is applicable to many types of indirect heat exchange apparatus, it is particularly efficacious in an internally air cooled turbine blade utilized in a gas turbine engine. As one skilled in the gas turbine engine technology will appreciate, it is abundantly important that the pressure and amount of cooling air utilized for cooling the airfoils of the turbine rotor is maintained to a minimum. Excess use of cooling air, which is typically bled off of the compressor of the gas turbine engine, would be a deficit in terms of engine performance. Obviously, the air being bled has already had work expended thereon by the compressor and this energy, if not converted into thrust or horsepower degrades engine performance. With the high demands for good engine performance, it is easy to understand the importance of holding the amount of cooling air to a minimum.

I have found that by tailoring the performance of the heat exchanger to match the temperature characteristics of the medium in which it is in indirect heat exchange, the overall performance of the heat exchanger can be significantly enhanced. In an airfoil environment, for example, the serpentine passages internally of the airfoil are "short circuited" in order to maximize the indirect heat exchange in areas that require high heat transfer and minimize indirect heat exchange in areas where the heat transfer requirement are less. Hence, the heat exchanger that is operating in an environment that has an external temperature gradient is tailored to provide maximum heat exchange transfer potential at the critical spans and consequently, improving the efficiency of the heat exchanger results in requiring less pressure at the airfoil inlet to flow the amount of air internally of the blade to attain the required cooling of the airfoil.

SUMMARY OF THE INVENTION

An object of this invention is to provide an improved heat exchanger;

A feature of this in invention is to provide in a heat exchanger as described means for tailoring the residence time in the passage of the heat exchanger to match the temperature profile of the medium in indirect heat exchange therewith.

Another feature of this invention is to provide in an internally air cooled airfoil of a gas turbine engine means for maximizing the heat transfer in high temperature areas and to minimize heat transfer in low temperature areas of the airfoil to match the external temperature gradient in heat exchange relation therewith.

A still further feature of this invention is to provide improved heat exchange means in the serpentine passageways of a turbine blade for a gas turbine engine by "short circuiting" the flow in discrete passageways to balance the temperature profile of the gas path adjacent said turbine blades to enhance the performance to the heat exchange characteristics of the blade and being characterized as being simple and inexpensive to implement without affecting the structural integrity of the blade while lowering the supply pressure that is required to move a specific amount of flow of cooling air internally of the blade.

The foregoing and other features of the present invention will become more apparent from the following description and accompanying drawings.

DETAILED DESCRIPTION OF THE DISCLOSURE

Figure 1:
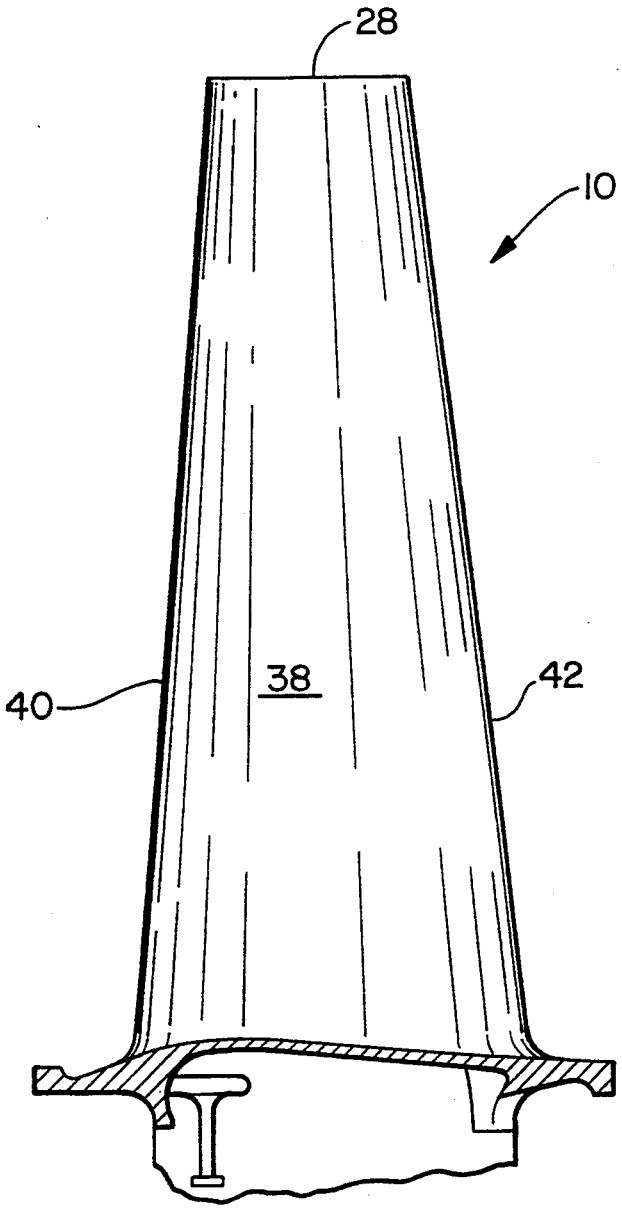
FIG. 1 is a partial view in elevation of an internally air-cooled turbine blade for a gas turbine engine.
Figure 2:
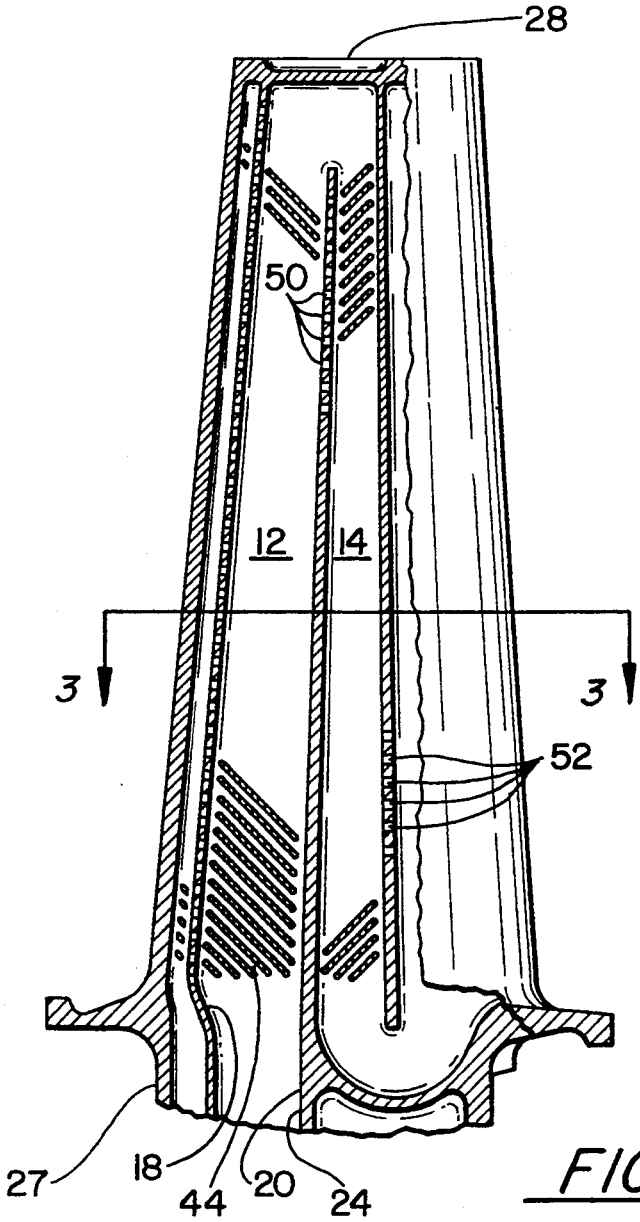
FIG. 2 is a view of the embodiment of FIG. 1 with a portion of the suction wall removed.
Figure 3:
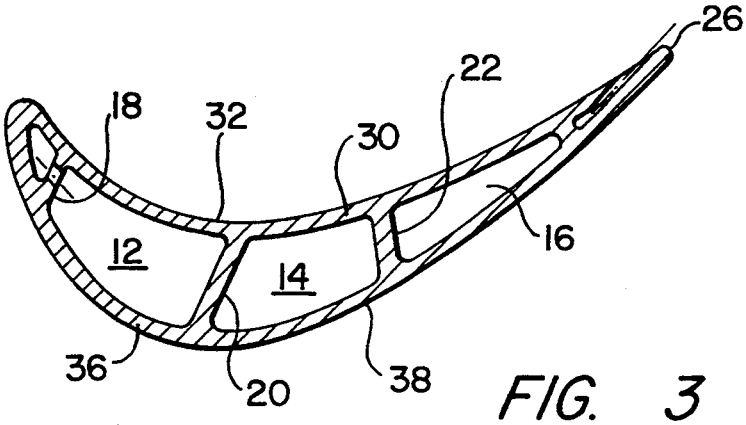
FIG. 3 is a sectional view taken along lines 3—3 of FIG. 2.

As mentioned above, while this invention has application for embodiments other than airfoils for gas turbine engines, the preferred embodiment of this invention is for airfoils of a turbine blade for gas turbine engines. As best seen in FIGS. 1–3 the turbine blade generally illustrated by reference numeral 10 is typically cast from metallic material capable of operation in the engines's hostile environment and includes internal air cooling serpentine passageways 12, 14 and 16 separated by elongated ribs 18, 20 and 22. Coolant, typically bled from one of the compressor stages (not shown), is admitted into the serpentine passageways through the inlet 24 disposed at the trailing edge 26 of blade 10.

From the foregoing it is apparent that coolant admitted internally of the blade at root 24 flows radially toward the tip 28 in passage 12, turns the corner of the end of elongated rib 20 flows toward the root 27 in passageway 14, turns again another 180 degrees and flows toward the tip 28 in passageway 16.

As noted in FIG. 3 the elongated ribs 18, 20 and 22 extend from the inner surface of the wall 30 on the pressure side 32 of the airfoil 10 to the inner surface of the wall 36 on the suction side 38 of airfoil 10. The serpentine passageways 12, 14, and 16 extend in the chordwise direction from proximity to the leading edge 40 toward proximity to the trailing edge 42. For the sake of simplicity and convenience the film cooling holes and the shower head holes typically employed in these types of blades are omitted herefrom. For further details of gas turbine engine turbine blades reference should be made to U.S. Pat. Nos. 4,775,296 granted to Schwarzmann et al on Oct. 4, 1988 entitled Coolable Airfoil for A Rotary Machine and 4,820,123, granted to Hall on Apr. 11, 1989 entitled "Dirt Removal Means for Air Cooled Blades" both of which are mutually assigned to United Technologies Corporation, the assignee of this patent application which are incorporated herein by reference.

Heat exchange augmenting devices such as trip strips 44 may be employed to enhance heat transfer for the air flowing through these serpentine passageways.

Figure 4:
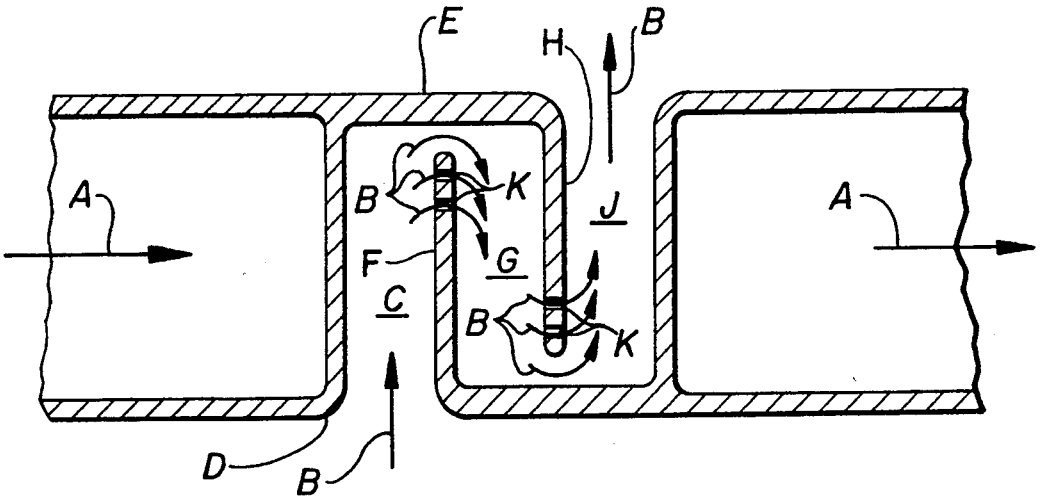
FIG. 4 is a partial view in section schematically illustrating the flow through the serpentine passageways of a blade.
Figure 5:
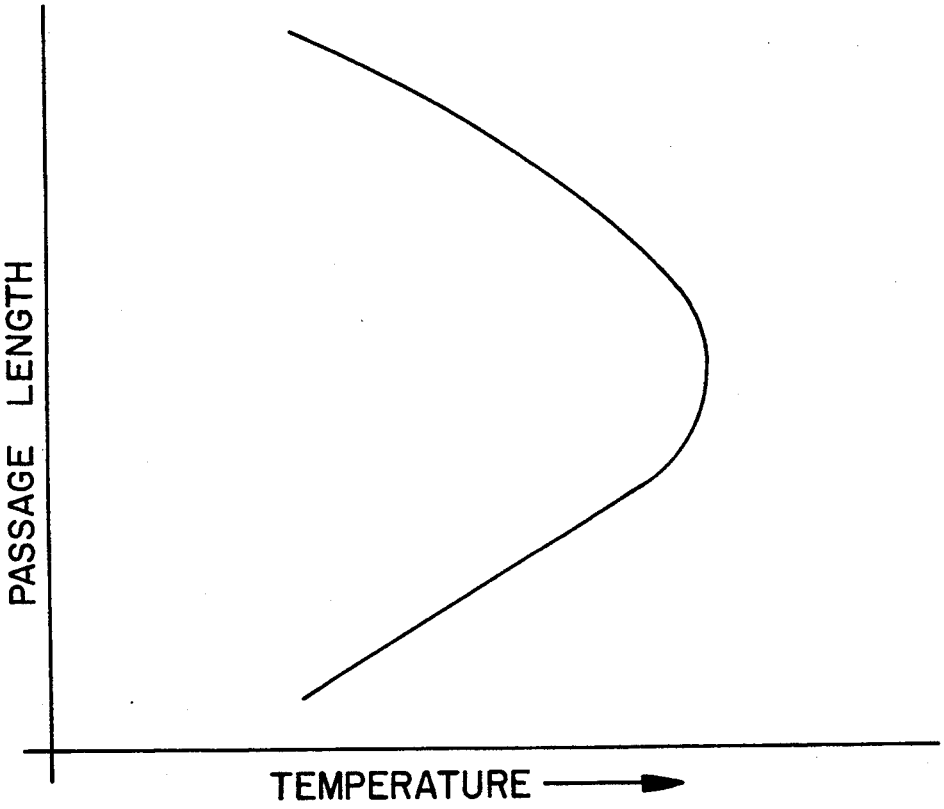
FIG. 5 is a graphical representation of the temperature gradient of the engine's gas path in proximity to the exterior surface of the airfoil section of the turbine blade.

The invention is best understood by referring to FIGS. 4 and 5. FIG. 4 is a sectional view that schematically illustrates this invention. The schematic is a blown up sectional view depicting an example of the flow of coolant in the serpentine passageways in heat exchange relationship with the exterior gas path flowing over the pressure and suction surfaces of the turbine airfoil. The arrows labeled A represent the gas path and the arrows labeled B represent the coolant flow. As noted, the arrow B entering the serpentine passageway C flows from the root D to the tip E turns 180 degrees at the end the rib F and flow toward the root D in passageway G, and again turns 180 degrees around rib H at the root of the blade and flows toward the tip E in passageway J.

Looking at the moment at the graph in FIG. 5, the temperature profile of the gas path where the temperature in proximity to root D and in proximity to the tip E is lower than the temperature intermediate thereof. In accordance with this invention the heat exchange function of the cooling serpentine passageways C, G and J which is in indirect heat exchange with the gas path flowing over the exterior of the airfoil, is tailored to match this profile. The ribs F and H include a plurality of radially spaced apertures K formed at the extremities thereof in the location where less heat exchange is required. This serves to "short circuit" the flow in the respective passageways, so that less heat transfer is taken place at these areas and heat transfer is high in the region therebetween. Obviously, this short circuiting of the flow paths in the serpentine passageways enhances the heat transfer characteristic of the passageways and the supply pressure required to flow the specific amount of coolant through the blade is reduced with a consequential increase in engine operating performance.

Returning back to FIG. 2, the blade depicted in this embodiment is likewise treated to match the temperature gradient of the external gas path of the engine. Radially spaced apertures 50 are formed adjacent to the upper end of rib 20 and radially spaced apertures 52 are formed adjacent to the lower end of rib 22. This serves to "short circuit" the flow of coolant in the respective serpentine passageway reducing the residence time thereof to match the temperature profile of the gas path that is in indirect heat exchange therewith.

As will be apparent to one skilled in the art the number of cross over apertures and their locations will be predicated on the particular application and the temperature profile being encountered. The invention allows the heat exchanger designer to tailor the performance of the heat exchanger to match the characteristics of the environment in which it operates. Specifically, a heat exchanger operating in an environment with an external temperature profile can be enhanced to provide maximum heat transfer potential at the critical spans.

As was shown in the preferred embodiment, the heat exchanger flow system is "short circuited" at areas of low required heat transfer and the heat exchanger potential at areas of high required heat transfer is maximized. Obviously by "short circuiting" at the walls to allow flow from one passageway to another, reduces the heat transfer in the regions where it is not critical, but keeps the heat transfer high where it is required.

Although this invention has been shown and described with respect to detailed embodiments thereof, it will be appreciated and understood by those skilled in the art that various changes in form and detail thereof may be made without departing from the spirit and scope of the claimed invention.

I claim:

1. For an internally cooled airfoil of a turbine blade of a gas turbine engine, a gas path of extremely high temperature gasses in said gas turbine engine and said airfoil being exposed to said gas path, said turbine blade including wall means defining a pressure side, a suction side, a tip, a root, a leading edge and a trailing edge, a first rib in proximity to said leading edge extending between said pressure side and said suction side of said wall means and extending radially from said root of said blade just short of said tip, a second rib in proximity of said trailing edge extending between said pressure side and said suction side of said wall means extending radially from said tip to just short of said root, said first rib and said second rib defining with said pressure side and said suction side serpentine passageways for leading cooling air flowing from said root to said tip and back to said root and back to said tip, said airfoil of said blade being in indirect heat exchange with the gas path of said gas turbine engine, the relationship of said gas path and said airfoil exposed to said gas path having a definitive temperature gradient where the coolest temperatures are in proximity to said root and said tip, means for matching the temperature gradient of said gas path with the temperature of said cooling air for enhancing heat transfer, said means including at least one cross over hole in said first rib disposed in proximity to said tip or said second rib in proximity to said root to bypass the end of said first rib or said second rib to flow the air in the adjacent passage to the next adjacent passage before reaching the end of said rib or said second rib, whereby the coolest air in the serpentine passageways is in indirect heat exchange with the hottest temperature of said temperature gradient.

2. For an internally cooled airfoil as claimed in claim 1 including a plurality of radially spaced cross over holes formed adjacent to the end of said first rib.

3. For an internally cooled airfoil as claimed in claim 2 including a plurality of radially spaced cross over holes adjacent one end of said second rib.

4. For an internally cooled airfoil as claimed in claim 3 including trip strips disposed in said serpentine passageways.

5. For an internally cooled airfoil as claimed in claim 1 wherein said first rib includes a cross over hole disposed in proximity to said tip and said second rib includes a cross over hole disposed in proximity to said root.

* * * * *

UNITED STATES PATENT AND TRADEMARK OFFICE

CERTIFICATE OF CORRECTION

PATENT NO. : 5,403,157

DATED : April 4, 1995

INVENTOR(S) : Robert P. Moore

It is certified that error appears in the above-identified patent and that said Letters Patent is hereby corrected as shown below:

Column 1, line 3,
After the Title insert the following paragraph:

--This invention was made under a U. S. Government contract and the Government has rights herein.--

Signed and Sealed this

Thirtieth Day of May, 1995

*Attest:*

Bruce Lehman

BRUCE LEHMAN

*Attesting Officer*

*Commissioner of Patents and Trademarks*